US006375785B1

(12) United States Patent
Aquarius

(10) Patent No.: US 6,375,785 B1
(45) Date of Patent: Apr. 23, 2002

(54) DEVICE FOR MANUFACTURING CUSHIONS FILLED WITH A GASEOUS MEDIUM

(75) Inventor: Pieter Theodorus Joseph Aquarius, Stramproy (NL)

(73) Assignees: Case Packaging Sales Europe BV, Stramproy (NL); Free-Flow Packaging International, Inc., Redwood City, CA (US)

( * ) Notice: Subject to any disclaimer, the term of this patent is extended or adjusted under 35 U.S.C. 154(b) by 0 days.

(21) Appl. No.: 09/549,788

(22) Filed: Apr. 14, 2000

(30) Foreign Application Priority Data

Apr. 15, 1999 (NL) ..... 1011809

(51) Int. Cl.[7] ..... B65B 9/10

(52) U.S. Cl. ..... 156/252; 156/285; 156/292; 156/513; 493/194

(58) Field of Search ..... 156/250, 252, 156/285, 292, 308.2, 308.4, 324, 510, 513, 580, 581, 583.1; 493/194, 203

(56) References Cited

U.S. PATENT DOCUMENTS 4,110,956 A * 9/1978 Weisberg ..... 53/558
4,384,442 A * 5/1983 Pendleton ..... 53/554
5,112,289 A * 5/1992 Kohn ..... 493/194

FOREIGN PATENT DOCUMENTS

EP 0787574 8/1997
EP 0836926 4/1998
JP 07016961 1/1995
JP 07165267 6/1995
WO 94 07678 4/1994
WO 98 40276 9/1998

* cited by examiner

*Primary Examiner*—James Sells
(74) *Attorney, Agent, or Firm*—Flehr Hohbach Test Albritton & Herbert LLP

(57) ABSTRACT

Device for manufacturing cushions filled with a gaseous medium from synthetic tubular foil. The device comprises supply means for supplying flexible tubular foil in a supply direction, perforation means situated at a first station for making a row of perforations in the tubular foil, introduction means situated at the first station for introducing a gaseous medium, and sealing means situated at the first station for making a transverse seal on either side of the row of perforations for closing off the tubular foil and sealing off the row of perforations. The supply means are provided with a plate which can be placed within the tubular foil and is kept within the tubular foil while the device is operative, which plate has a top side and a bottom side situated at a distance from it, a first side wall and a second side wall situated at a distance from it for keeping the walls of the tubular foil apart, the plate in both main planes being provided with at least one retaining recess, the retaining recesses being situated opposite each other, and in which the device is provided with at least two retaining rollers for abutment in the respective retaining recesses. The introduction means are provided with at least one blast pipe mounted on a vise-grip wrench, which vise-grip wrench can be moved to and from a respective side wall of the plate until in abutment with the tubular foil, the blast pipe being moveable until in the continuous opening for making an introduction perforation for introducing a gaseous medium in the tubular foil.

30 Claims, 2 Drawing Sheets

DEVICE FOR MANUFACTURING CUSHIONS FILLED WITH A GASEOUS MEDIUM

Figure 1:
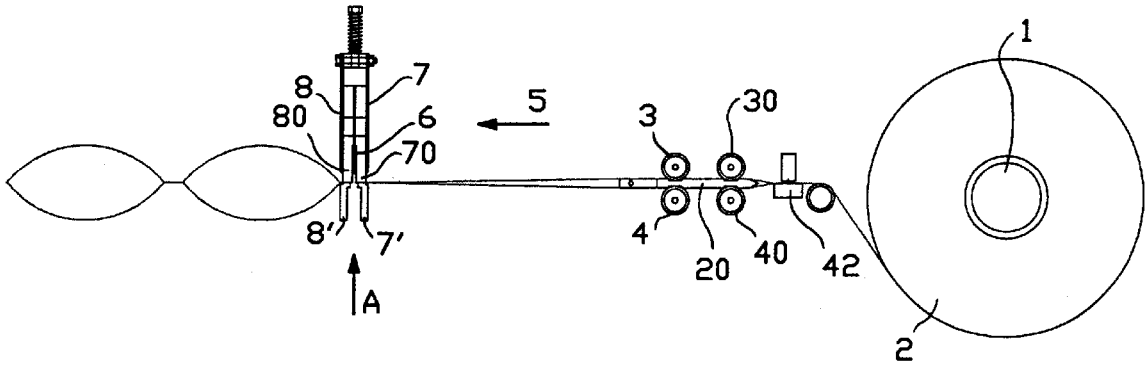

The present invention relates to a device for manufacturing cushions filled with a gaseous medium, for instance air, from synthetic foil, for instance tubular foil.

International patent application WO94/07678 describes such a device for manufacturing small air-filled cushions or bags, for use as protective filling material when packaging fragile parts and other objects in cargo boxes or the like. The cushions are made by forming a seal over the tubular foil, introducing air into the foil by inserting a needle through the wall of the tubular foil, and subsequently forming another seal over the tubular foil where the air was introduced to close off the cushion and to seal off the hole made by the needle. Consecutive cushions leave the device separately or as a number of cushions connected to each other, which can be separated in order to be used separately.

In practice it appeared that said device has some limitations and drawbacks, and that many cushions are not sufficiently filled with air. Because of the flexible tubular foil it is difficult to insert the needle through the wall of the tubular foil, without the needle pricking through the wall (or the opposite wall) for a second time. When this happens air escapes via the second hole before the holes have been sealed off. When the second hole is outside the area that will be sealed off the air will continuously escape even after the cushion has been sealed off. Moreover said known device for manufacturing bags filled with a gaseous medium is provided with various stations for performing the various necessary treatments, such as sealing, the introduction of air, the separation of adjacent bags. This renders the device somewhat sizeable.

It is amongst others an object of the present invention to provide a device for manufacturing a cushion filled with a gaseous medium, with which cushions can reproducibly be filled, and which has a very compact construction.

To that end the present invention in a first aspect provides a device for manufacturing cushions filled with a gaseous medium from synthetic tubular foil, which device is provided with supply means for supplying flexible tubular foil in a supply direction, perforation means for making a row of perforations in the tubular foil, which row extends transverse to the supply direction, which perforation means are situated at a first station, introduction means for introducing a gaseous medium, which introduction means are situated at the first station, sealing means for making a transverse seal on either side of the row of perforations for closing off the tubular foil and sealing off the row of perforations, which sealing means are situated at the first station, in which the supply means for supplying flexible tubular foil in a supply direction are provided with a plate which can be placed within the tubular foil and is kept within the tubular foil while the device is operative, which plate has a top side and a bottom side situated at a distance from it, a first side wall and a second side wall situated at a distance from it for keeping the walls of the tubular foil apart, in which at least one of the side walls of the plate is provided with a continuous opening for guiding the gaseous medium to the tubular foil, the top side and bottom side of the plate being provided with at least one retaining recess, the retaining recesses being situated opposite each other, and with at least two retaining rollers for abutment in the respective retaining recesses, in which the introduction means for introducing a gaseous medium are provided with at least one blast pipe mounted on a vise-grip wrench, which vise-grip wrench can be moved to and from a respective side wall of the plate until in abutment with the tubular foil, the blast pipe being moveable until in the continuous opening for making an introduction perforation for introducing a gaseous medium in the tubular foil. By inserting gaseous medium in the tubular foil in this manner, and sealing off the perforation on either side after that, a reproducible filling with gaseous medium is guaranteed. Because all treatments take place at one station, not only is the construction of the device compact, but it is also possible to freely choose the length of the cushion filled with gaseous medium. In the known device the length of the cushion is determined by the distance between the separate stations, and therefore cannot vary. Moreover perforation of the tubular foil takes place in a very defined manner by the blast pipe, also because the tubular foil is clamped between the plate and vise-grip wrench during perforation. As a result a reproducible filling of the cushion is realized.

According to a second aspect of the invention a device is provided for manufacturing cushions filled with a gaseous medium from synthetic tubular foil, which device is provided with supply means for supplying flexible tubular foil in a supply direction, perforation means for making a row of perforations in the tubular foil, which row extends transverse to the supply direction, which perforation means are situated at a first station, introduction means for introducing a gaseous medium, which introduction means are situated at the first station, sealing means for making a transverse seal on either side of the row of perforations for closing off the tubular foil and sealing off the row of perforations, which sealing means are situated at the first station, in which the supply means for supplying flexible tubular foil in a supply direction are provided with a plate which can be placed within the tubular foil and is kept within the tubular foil while the device is operative, which plate has a top side and a bottom side situated at a distance from it and a front wall for keeping the walls of the tubular foil apart, in which the plate is provided with an opening continuous from the top side to the bottom side and with at least one duct going from the opening to the front wall for guiding the gaseous medium to the tubular foil, the top side and bottom side of the plate being provided with at least one retaining recess, the retaining recesses being situated opposite each other, and with at least two retaining rollers for abutment in the respective retaining recesses, in which the introduction means for introducing a gaseous medium are provided with at least one blast pipe mounted on a vise-grip wrench, which vise-grip wrench can be moved to and from the top side or bottom side of the plate respectively until in abutment with the tubular foil, the blast pipe being moveable until in the opening for making an introduction perforation for introducing a gaseous medium in the tubular foil. Here perforation of the tubular foil by the blast pipe takes place from above in a very defined manner. The thickness of the plate makes it possible that the blast pipe extends into the opening and therefore does not extend through the other side of the tubular foil.

According to a third aspect the present invention provides a device for manufacturing cushions filled with a gaseous medium from synthetic tubular foil, which device is provided with:

- supply means for supplying flexible tubular foil in a supply direction,
- perforation means for making a row of perforations in the tubular foil, which row extends transverse to the supply direction, which perforation means are situated at a first station,
- cutting means for making a longitudinal cut in the tubular foil, introduction means for introducing a gaseous medium, which introduction means are situated at the first station, sealing means for making a transverse seal on either side of the row of perforations for closing off the tubular foil and sealing off the row of perforations, which sealing means are situated at the first station, in which the supply means for supplying flexible tubular foil in a supply direction are provided with a plate which can be placed within the tubular foil and is kept within the tubular foil while the device is operative, which plate has a top side and a bottom side situated at a distance from it, a first side wall and a second side wall situated at a distance from it for keeping the walls of the tubular foil apart, in which at least one of the side walls of the plate is provided with a continuous opening for guiding the gaseous medium to the tubular foil, the top side and bottom side of the plate being provided with at least one retaining recess, the retaining recesses being situated opposite each other, sealing means for arranging a longitudinal seal for closing off the longitudinal cut of the tubular foil, and with at least two retaining rollers for abutment in the respective retaining recesses, in which the introduction means for introducing a gaseous medium are provided with at least one blast pipe mounted on a vise-grip wrench, which vise-grip wrench can be moved to and from a respective side wall of the plate until in abutment with the tubular foil, the blast pipe being moveable until in the continuous opening and in the longitudinal cut of the tubular foil for introducing a gaseous medium in the tubular foil.

According to a fourth aspect the present invention provides a device for manufacturing cushions filled with a gaseous medium from synthetic centrefold foil, which device is provided with:

supply means for supplying flexible foil in a supply direction, perforation means for making a row of perforations in the foil, which row extends transverse to the supply direction, which perforation means are situated at a first station, introduction means for introducing a gaseous medium, which introduction means are situated at the first station, sealing means for making a transverse seal on either side of the row of perforations for closing off the foil and sealing off the row of perforations, which sealing means are situated at the first station, in which the supply means for supplying flexible foil in a supply direction are provided with a plate which can be placed within the foil and is kept within the foil while the device is operative, which plate has a top side and a bottom side situated at a distance from it, a first side wall and a second side wall situated at a distance from it for keeping the walls of the foil apart, in which at least one of the side walls of the plate is provided with a continuous opening for guiding the gaseous medium to the foil, the top side and bottom side of the plate being provided with at least one retaining recess, the retaining recesses being situated opposite each other, sealing means for arranging a longitudinal seal for closing off the centrefold foil, and with at least two retaining rollers for abutment in the respective retaining recesses, in which the introduction means for introducing a gaseous medium are provided with at least one blast pipe mounted on a vise-grip wrench, which vise-grip wrench can be moved to and from a respective side wall of the plate until in abutment with the foil, the blast pipe being moveable until in the continuous opening and in the centrefold foil for introducing a gaseous medium in the tubular foil.

Figure 2:
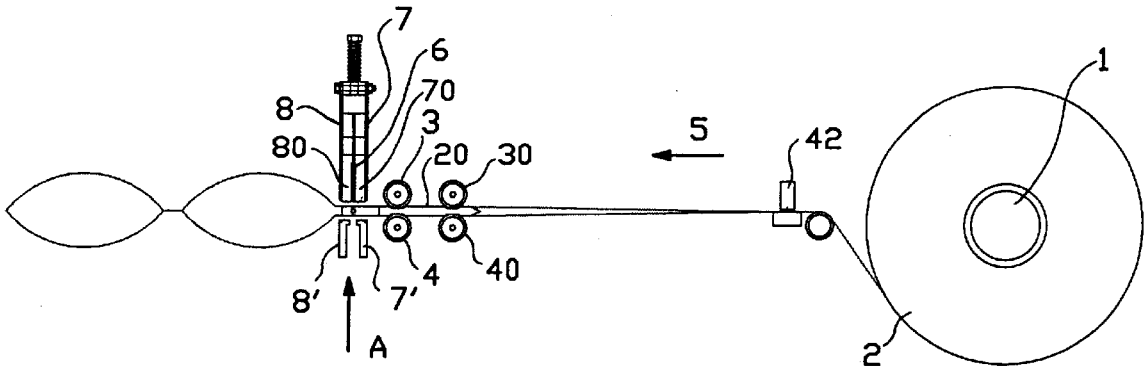
Figure 3:
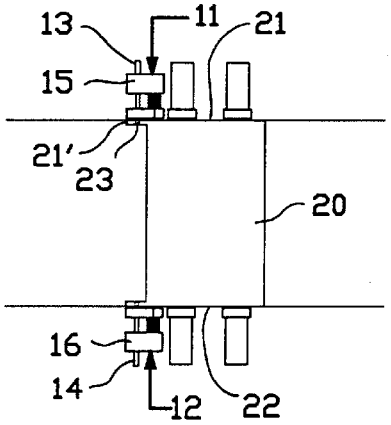
Figure 4:
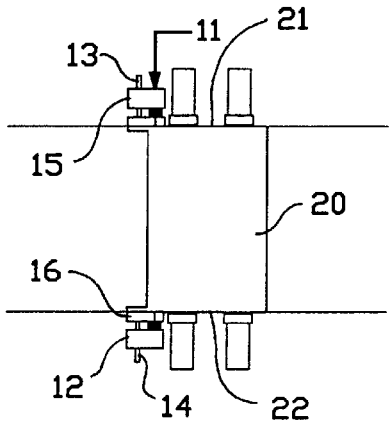
Figure 5:
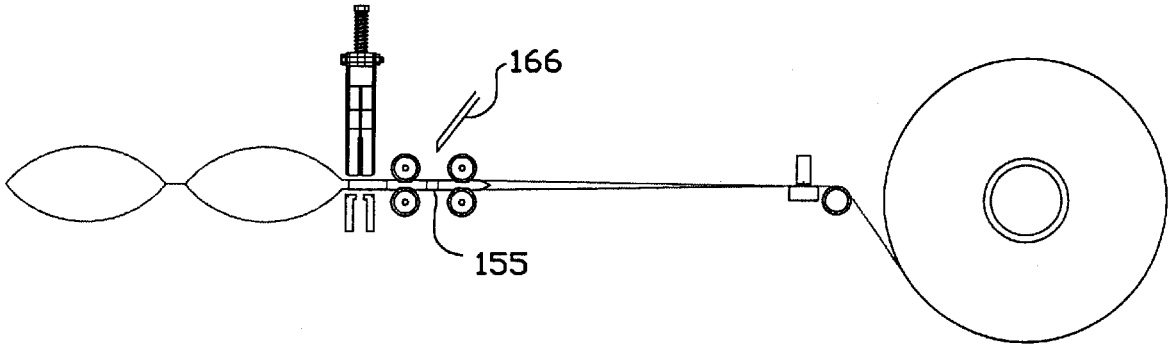
Figure 6:
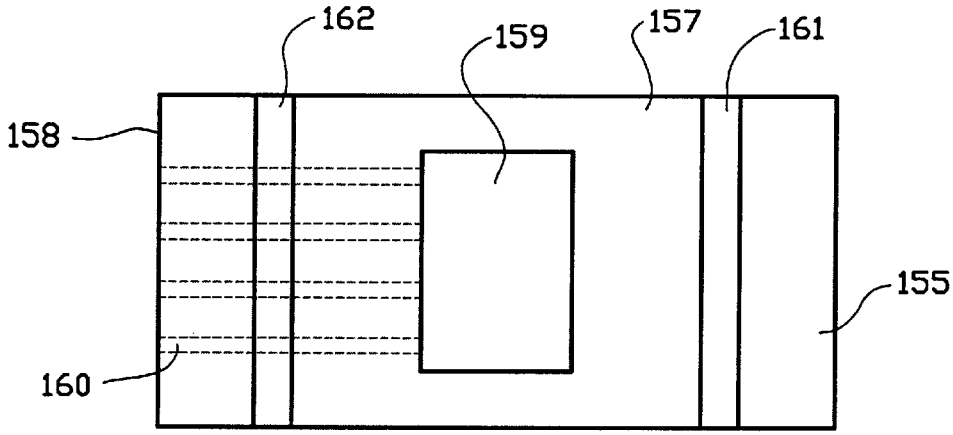

Further embodiments and advantages of a device for manufacturing cushions filled with a gaseous medium will appear clearly on the basis of the description given below of some exemplary embodiments of the invention, which should be considered merely as illustrations and not as limiting. In which drawing:

FIG. 1 schematically shows a device according to the invention with blowing in via the side wall in the seal and perforation position;

FIG. 2 schematically shows a device according to the invention with blowing-in via the side wall in the blowing and transportation position;

FIG. 3 schematically shows the introduction means according to the invention in the position in which the blast pipe is not yet inserted through the side wall of the tubular foil;

FIG. 4 schematically shows the introduction means according to the invention in the position in which the blast pipe is inserted through the side wall of the tubular foil;

FIG. 5 schematically shows a device according to the invention with blowing-in via the top side; and FIG. 6 schematically shows the plate which can be used in the embodiment according to FIG. 5.

The present invention will below be described on the basis of air as gaseous medium. It will however be clear that cushions or bags can also be filled with another gaseous medium such as nitrogen, oxygen, helium and the like.

Furthermore the operation of the parts will not be described as this is standard in the art. For instance the movements can be generated by electric motors. Furthermore the reciprocal movements of the separate parts can also be caused by separate motors, or by common control by means of a driven curve roller. Examples of such a drive can for instance be found in European patent application No. 0.836.926, and in the above-mentioned International patent application.

In the FIGS. 1–4 an exemplary embodiment of a device according to the invention is described, in which the blast pipe is moved in the direction towards the side wall of the plate, in other words is inserted through the side wall of the plate. This is also called blowing in via the side wall.

In FIGS. 1 and 2 an exemplary embodiment of a device for the manufacturing of air-filled cushions is schematically shown in the different positions, namely the position for sealing and perforating the tubular foil, and the position for transporting and introducing air in the tubular foil.

The device preferably is provided with a carrier 1 for carrying the roll of tubular foil 2. However, it is also possible that the tubular foil 2 is supplied by a separate supply device.

The device is provided with two transport rollers 3, 4 in between which the tubular foil 2 can be passed. The two transport rollers 3, 4 preferably are springmounted with respect to each other, and press against each other to such an extent that they hold the tubular foil 2. By a movement of the transport rollers 3, 4 (in the drawing from the left to the right) the tubular foil 2 is taken along and transported in a supply direction 5 through the device. At their surfaces the transport rollers 3, 4 are provided in a known manner with a material of a sufficiently high friction coefficient.

Furthermore the device comprises perforation means 6 for making a row of perforations in the tubular foil, which row extends transverse to the supply direction 5. Said perforation means 6 are situated at a first station A. Preferably the perforation means 6 are provided with a blade which can be moved transverse to a plane of the tubular foil 2 and which blade has a number of teeth. Each tooth is suitable for making a perforation in the tubular foil 2. The perforation means 6 further comprise two pairs of jaws 7, 8 ; 7', 8' placed on either side of the blade 6 for clampingly engaging the tubular foil 2 while the perforations are being made.

Although one pair of jaws can be fixedly arranged, and the other pair of jaws is moveable transverse to a plane of the tubular foil 2 until in abutment with the tubular foil 2, it is preferred that both pairs of jaws 7, 8 ;7', 8' are moveable transverse to the plane of the tubular foil 2 until in abutment with the tubular foil 2.

Furthermore the perforation means can be designed as two opposite blades, but in order to obtain a very compact construction it is preferred that only one blade is provided which is situated between two adjacent jaws (7, 8 in the shown example) of one pair of jaws.

The blade 6 thus provides perforations when penetrating through the tubular foil 2. It is of importance here that the distance over which the blade moves through the tubular foil 2 is smaller than the size of the teeth of the blade 6, for forming separate perforations. Said perforations for instance serve for tearing the bags situated adjacent to each other from each other. However, it is also possible to move the blade 6 over such a distance, depending on the size of the teeth, through the tubular foil, that the tubular foil is cut through.

Introduction means 11, 12, 20 for introducing a gaseous medium comprise at least one blast pipe 13, 14 mounted on a vise-grip wrench 15 or 16, respectively, and a plate 20 which can be placed within the tubular foil 2. The plate 20 is also a part of the supply means for supplying flexible tubular foil 2 in a supply direction.

Said plate 20 can be placed within the tubular foil and during operation of the device is held within the tubular foil, and has a top side and bottom side which is situated at a distance from it, a first side wall 21 and a second side wall 22 situated at a distance from it for keeping the walls of the tubular foil 2 apart (see FIGS. 3 and 4). At least one of the side walls 21, 22 of the plate 20 is provided with a continuous opening 23 or 24, respectively, for guiding the gaseous medium into the tubular foil. The top side and bottom side of the plate 20 are provided with at least one retaining recess, the retaining recesses being situated opposite each other.

Each vise-grip wrench 15, 16 can be moved to and from a respective side wall 21, 22 of the plate 20 until in abutment with the tubular foil 2. The blast pipe 13, 14 can be moved until in the continuous opening (see FIG. 4) for making an introduction perforation for introducing a gaseous medium into the tubular foil. Said introduction perforation is very defined and reproducible. Preferably the introduction perforation is situated in line with the row of perforations, as a result of which a simple beginning for tearing along the row of perforations is provided.

For introducing air into the tubular foil 2 via the introduction perforation, the introduction means are provided with blast pipes for guiding air through them under pressure by means of a compressor. Alternatively it may be possible however that sir is sucked in via the blast pipe or the introduction perforation, by using the transportation speed of the tubular foil.

During operation of the device said plate 20 is kept within the tubular foil 2. To that end as described above the plate 20 is provided in its top surface and bottom surface (FIG. 1, 2) with respective retaining recesses, which are situated opposite each other. The two transport rollers 3, 4 also form retaining rollers, which lie such in the retaining recesses that the plate 20 and the tubular foil 2 are retained during operation. Preferably two pairs of retaining rollers 3, 4 and 30, 40 are provided and the plate 20 contains corresponding recesses. The plate 20 keeps the walls of the tubular foil 2 apart, so that air can easily be introduced into the tubular foil 2, as described later on.

The side walls 21, 22 of the plate 20 preferably have projections 21', 22' through which the continuous openings 23, 24 extend, in which the respective blast pipes 13, 14 can be inserted (FIG. 4) by suitable operation of the respective vise-grip wrench.

For obtaining a compact though simple construction the sealing means comprise sealing jaws 70, 80 (in this exemplary embodiment) situated between the two jaws 7, 8. A seal in a synthetic foil is made here by means of sealing with heat. To that end the sealing jaws comprise heating means. Said heating means comprise heated planes in between which the foil is clamped and is sealed by means of heating.

Below on the basis of FIGS. 1 and 2 the operation of the device according to the present invention will be discussed in short.

In FIG. 2 the blowing/transport position of the device is shown, in which the jaws 7, 8; 7', 8', and the sealing jaws as well as a security blocking 42 do not exert a retaining clamping action on the tubular foil 2.

When the tubular foil 2 has moved over a wanted distance through the device as a result of corresponding movement of the transport rollers 3, 4; 30, 40, the pairs of jaws 7, 8; 7', 8' are moved until in abutment with each other. As a result the tubular foil 2 can no longer move. In the position shown in FIG. 1 said security blocking 42 may also clamp the tubular foil 2. In this position (FIG. 1) the blade 6 is moved downwards, so that a row of perforations is formed. Subsequently the blade 6 is moved upwards again until at a distance from the tubular foil 2.

After that the jaws 7, 8; 7', 8' are moved apart, and by means of a movement in the supply direction 5 of the transport rollers 3, 4; 30, 40 the plate 20 is moved forward over such a distance that the continuous openings 23, 24 of the plate 20 come to lie next to the blast pipes 13, 14. After that the vise-grip wrenches are moved so that the blast pipes enter the continuous openings and air can be introduced into the tubular foil, as a result of which a filled cushion 25 is made.

Subsequently the blast pipes are removed, and the plate 20 is moved back into its initial position. After that the sealing jaws 70, 80 are brought into abutment with the tubular foil 2, and an accompanying part of the jaws 7', 8', for making the transverse seals. Possibly after that the blade 6 can be lowered such that the cushion made is cut off from the rest of the tubular foil 2.

An extremely important additional advantage of a device according to the present invention is that now cushions of various lengths can be made. In order to still obtain sufficient filling of larger cushions, either the air pressure for introducing air is increased or the period of time during which the air is introduced is increased.

The introduction of gaseous medium is also possible by first providing the tubular foil with a longitudinal cut with the help of cutting means, and subsequently inserting the blast pipe in the tubular foil through the longitudinal cut. In this way an introduction opening need not be made. However, the longitudinal cut has to be sealed after that by the sealing means.

Alternatively it is possible to use centrefold foil instead of tubular foil. When using said foil it is not necessary to use cutting means.

In FIG. 5 an exemplary embodiment of a device according to the invention is described, in which the blast pipe is moved in the direction of the top side of the plate 155, in other words is inserted through the top side of the foil. This is also called blowing in via the top side. Alternatively it is also possible of course to blow in via the bottom side.

The position shown in FIG. 5 corresponds to the position shown in FIG. 2, in which now the blast pipe or blast pipes, schematically shown by 156, can be moved from and to the top side of the plate 155 and are inserted through the top side of the foil. Because the walls of the foil are kept at a distance from each other by the plate 155, it is possible to prevent the blast pipe from also pricking through the other wall of the foil, the bottom side of the foil.

In FIG. 6 the plate 155 used in FIG. 5 is schematically shown. The plate 156 has a top side 157, a bottom side situated at a distance from it and a front wall 158. The plate 155 is provided with an opening 159 which is continuous from the top side to the bottom side and with at least one duct 160 going from the opening 159 to the front wall 158. The opening 159 and the ducts 160 guide the gaseous medium introduced through the blast pipe to the tubular foil.

In this exemplary embodiment, the top side and bottom side of the plate 155 are provided with two pairs of retaining recesses 161, 162.

What is claimed is:

1. Device for manufacturing cushions filled with a gaseous medium from synthetic tubular foil, which device is provided with:

supply means for supplying flexible tubular foil in a supply direction, perforation means for making a row of perforations in the tubular foil, which row extends transverse to the supply direction, which perforation means are situated at a first station, introduction means for introducing a gaseous medium, which introduction means are situated at the first station, sealing means for making a transverse seal on either side of the row of perforations for closing off the tubular foil and sealing the row of perforations, which sealing means are situated at the first station, in which the supply means for supplying flexible tubular foil in a supply direction are provided with a plate which can be placed within the tubular foil and is kept within the tubular foil while the device is operative, which plate has a top side and a bottom side situated at a distance from it, a first side wall and a second side wall situated at a distance from it for keeping the walls of the tubular foil apart, in which at least one of the side walls of the plate is provided with a continuous opening for guiding the gaseous medium to the tubular foil, the top side and bottom side of the plate being provided with at least one retaining recess, the retaining recesses being situated opposite each other, and with at least two retaining rollers for abutment in the respective retaining recesses, in which the introduction means for introducing a gaseous medium are provided with at least one blast pipe mounted on a vise-grip wrench, which vise-grip wrench can be moved to and from a respective side wall of the plate until in abutment with the tubular foil, the blast pipe being moveable until in the continuous opening for making an introduction perforation for introducing a gaseous medium in the tubular foil.

2. Device for manufacturing cushions filled with a gaseous medium from synthetic tubular foil, which device is provided with:

supply means for supplying flexible tubular foil in a supply direction, perforation means for making a row of perforations in the tubular foil, which row extends transverse to the supply direction, which perforation means are situated at a first station, introduction means for introducing a gaseous medium, which introduction means are situated at the first station, sealing means for making a transverse seal on either side of the row of perforations for closing off the tubular foil and sealing the row of perforations, which sealing means are situated at the first station, in which the supply means for supplying flexible tubular foil in a supply direction are provided with a plate which can be placed within the tubular foil and is kept within the tubular foil while the device is operative, which plate has a top side and a bottom side situated at a distance from it and a front wall for keeping the walls of the tubular foil apart, in which the plate is provided with an opening continuous from the top side to the bottom side and with at least one duct going from the opening to the front wall for guiding the gaseous medium to the tubular foil, the top side and bottom side of the plate being provided with at least one retaining recess, the retaining recesses being situated opposite each other, and with at least two retaining rollers for abutment in the respective retaining recesses, in which the introduction means for introducing a gaseous medium are provided with at least one blast pipe mounted on a vise-grip wrench, which vise-grip wrench can be moved to and from a the top side or bottom side of the plate respectively until in abutment with the tubular foil, the blast pipe being moveable until in the opening for making an introduction perforation for introducing a gaseous medium in the tubular foil.

3. Device according to claim 1, in which the perforation means for making a row of perforations in the tubular foil are provided with a blade which can be moved transverse to a plane of the tubular foil and which blade has a number of teeth each for making a perforation in the tubular foil, and with two pairs of jaws placed on either side of the blade for clampingly engaging the tubular foil for holding the tubular foil while the perforations are being made, the tubular foil being transportable between the pairs of jaws, at least one pair of jaws being movable transverse to a plane of the tubular foil until in abutment with the tubular foil.

4. Device according to claim 3, in which the blade is situated between two adjacent jaws of one pair of jaws.

5. Device according to claim 3, in which both pairs of jaws can be moved transverse to a plane of the tubular foil until in abutment with the tubular foil.

6. Device according to claim 3, in which the blade can be moved over such a distance that the tubular foil can be cut through.

7. Device according to claim 1 in which the retaining rollers can be moved in the supply direction.

8. Device according to claim 1 in which the sealing means for making a transverse seal on either side of the row of perforations for closing off the tubular foil and sealing the row of perforations are sealing jaws situated between the one pair of jaws.

9. Device according to claim 1 in which the sealing means comprise heating means.

10. Device according to claim 1 in which the device is provided with a carrier for carrying a roll of tubular film.

11. Device for manufacturing cushions filled with a gaseous medium from synthetic tubular foil, which device is provided with:

supply means for supplying flexible tubular foil in a supply direction, perforation means for making a row of perforations in the tubular foil, which row extends transverse to the supply direction, which perforation means are situated at a first station, cutting means for making a longitudinal cut in the tubular foil, introduction means for introducing a gaseous medium, which introduction means are situated at the first station, sealing means for making a transverse seal on either side of the row of perforations for closing off the tubular foil and sealing the row of perforations, which sealing means are situated at the first station, in which the supply means for supplying flexible tubular foil in a supply direction are provided with a plate which can be placed within the tubular foil and is kept within the tubular foil while the device is operative, which plate has a top side and a bottom side situated at a distance from it, a first side wall and a second side wall situated at a distance from it for keeping the walls of the tubular foil apart, in which at least one of the side walls of the plate is provided with a continuous opening for guiding the gaseous medium to the tubular foil, the top side and bottom side of the plate being provided with at least one retaining recess, the retaining recesses being situated opposite each other, sealing means for arranging a longitudinal seal for closing off the longitudinal cut of the tubular foil, and with at least two retaining rollers for abutment in the respective retaining recesses, in which the introduction means for introducing a gaseous medium are provided with at least one blast pipe mounted on a vise-grip wrench, which vise-grip wrench can be moved to and from a respective side wall of the plate until in abutment with the tubular foil, the blast pipe being moveable until in the continuous opening and in the longitudinal cut of the tubular foil for introducing a gaseous medium in the tubular foil.

12. Device for manufacturing cushions filled with a gaseous medium from synthetic centrefold foil, which device is provided with:

supply means for supplying flexible foil in a supply direction, perforation means for making a row of perforations in the foil, which row extends transverse to the supply direction, which perforation means are situated at a first station, introduction means for introducing a gaseous medium, which introduction means are situated at the first station, sealing means for making a transverse seal on either side of the row of perforations for closing off the foil and sealing the row of perforations, which sealing means are situated at the first station, in which the supply means for supplying flexible foil in a supply direction are provided with a plate which can be placed within the foil and is kept within the foil while the device is operative, which plate has a top side and a bottom side situated at a distance from it a first side wall and a second side wall situated at a distance from it for keeping the walls of the foil apart, in which at least one of the side walls of the plate is provided with a continuous opening for guiding the gaseous medium to the foil, the top side and bottom side of the plate being provided with at least one retaining recess, the retaining recesses being situated opposite each other, sealing means for arranging a longitudinal seal for closing off the centrefold foil, and with at least two retaining rollers for abutment in the respective retaining recesses, in which the introduction means for introducing a gaseous medium are provided with at least one blast pipe mounted on a vise-grip wrench, which vise-grip wrench can be moved to and from a respective side wall of the plate until in abutment with the foil, the blast pipe being moveable until in the continuous opening and in the centrefold foil for introducing a gaseous medium in the tubular foil.

13. Apparatus for manufacturing gas filled cushions from a length of flattened tubing, comprising: a plate adapted to be positioned within the tubing and having recesses in opposite surfaces thereof, a pair of drive elements exteriorly engagable with the recesses through the walls of the tubing for advancing the tubing toward a processing station, means at the processing station for injecting a gas into the tubing to inflate it, and means at the processing station for sealing the tubing to confine the gas with in it.

14. The apparatus of claim 13 wherein the recesses are formed in the major surfaces of the plate and extend transversely to the direction in which the tubing is advanced, and the drive elements are rollers.

15. The apparatus of claim 13 wherein the means for injecting a gas into the tubing comprises a blast pipe which is movable into puncturing engagement with one wall of the tubing.

16. The apparatus of claim 15 wherein the plate has an opening in which the blast pipe is received.

17. The apparatus of claim 16 wherein the plate also has a passageway communicating with the opening for guiding gas from the blast pipe into the tubing.

18. The apparatus of claim 15 wherein the blast pipe is moved into puncturing engagement with a side wall of the tubing.

19. The apparatus of claim 15 wherein the blast pipe is moved into puncturing engagement with the top wall of the tubing.

20. The apparatus of claim 13 further including means at the processing station for forming a row of perforations across the tubing.

21. The apparatus of claim 20 wherein the means for sealing the tubing includes means for making a transverse seal on either side of the row of perforations.

22. A method of manufacturing gas filled cushions from a length of flattened tubing, comprising the steps of: positioning a plate having recesses in opposite surfaces thereof within the tubing, engaging the recesses with a pair of drive elements through the walls of the tubing, moving the drive elements toward a processing station to advance the tubing toward the processing station, injecting a gas into the tubing at the processing station to inflate the tubing, and for sealing the tubing at the processing station to confine the gas with in the tubing.

23. The method of claim 22 including the step of puncturing a wall of the tubing with a blast pipe through which the gas is injected.

24. The method of claim 23 wherein the blast pipe is inserted into an opening in the plate.

25. The method of claim 24 wherein the gas is guided into the tubing through a passageway in the plate which communicates with the opening.

26. The method of claim 23 wherein the blast pipe punctures a side wall of the tubing.

27. The method of claim 23 wherein the blast pipe punctures the top wall of the tubing.

28. The method of claim 22 further including the step of forming a row of perforations across the tubing.

29. The method of claim 28 wherein a transverse seal is made on either side of the row of perforations.

30. The method of claim 22 wherein the drive elements are advanced in discrete steps between seals to determine the length of the cushions.

* * * * *